US009909295B2

(12) United States Patent
Brackett, Sr. et al.

(10) Patent No.: US 9,909,295 B2
(45) Date of Patent: Mar. 6, 2018

(54) IN-TOILET LEAK DETECTOR

(71) Applicant: Leak Beeper, LLC, Franklin, TN (US)

(72) Inventors: James A Brackett, Sr., Franklin, TN (US); John Beal, Delaware, OH (US); Timothy Bottger, Brooklyn Park, MN (US)

(73) Assignee: Leak Beeper, LLC, Franklin, TN (US)

( * ) Notice: Subject to any disclaimer, the term of this patent is extended or adjusted under 35 U.S.C. 154(b) by 330 days.

(21) Appl. No.: 14/656,567

(22) Filed: Mar. 12, 2015

(65) Prior Publication Data

US 2016/0265208 A1 Sep. 15, 2016

(51) Int. Cl.

| | |
|---|---|
| ***E03D 1/00*** | (2006.01) |
| ***G08B 21/00*** | (2006.01) |
| ***E03D 11/00*** | (2006.01) |

(52) U.S. Cl.

CPC ..... *E03D 11/00* (2013.01); *E03D 2201/00* (2013.01)

(58) Field of Classification Search

CPC ..... E03D 11/00
USPC ..... 4/314
See application file for complete search history.

(56) References Cited

U.S. PATENT DOCUMENTS 6,802,084 B2 * 10/2004 Ghertner ..... E03D 1/00 340/605
7,950,265 B2 5/2011 Bowcutt et al.
7,969,318 B2 6/2011 White et al.
8,134,372 B2 3/2012 King et al.
8,844,067 B2 9/2014 Quintana et al.
2014/0053329 A1 * 2/2014 Schuster ..... E03D 1/32 4/314
2015/0059074 A1 * 3/2015 Davies ..... G01F 23/0007 4/314

OTHER PUBLICATIONS

Fluidmaster. "FAQs About the Fluidmaster 400LS Leak Sentry Toilet Fill Valve." Internet. Available at http://www.fluidmaster.com/toilet-fill-valve-with-leak-sentry.html. Visited Mar. 24, 2015.
Green Energy Management Services. "GEM Water Management Valve." Internet. Available at http://web.archive.org/web/20130405055520/http://gempowered.com/index.php/gem/airlock. Archived Apr. 5, 2013.

(Continued)

*Primary Examiner* — Christine Skubinna
(74) *Attorney, Agent, or Firm* — Andrew McAleavey; PatentBest

(57) ABSTRACT

An in-toilet leak detector is disclosed, as are communication systems for reporting toilet leaks. The leak detector comprises an inlet that receives water from the toilet's fill tube and diverts it through a flow tube. A capacitive sensor is located between the inlet and an opening of the flow tube from which water flows into the overflow tube of the toilet tank. A housing is connected to the flow tube and the inlet and contains a controller and other electronics, including one or more transceivers. The leak detector measures the duration of water flow and establishes an alert if the water flow is shorter or longer in duration than a calibrated normal duration. The transceivers connect the leak detector to a computer network, and leak alerts are communicated to a server or servers so that they can be forwarded directly to those responsible for fixing the toilets.

18 Claims, 7 Drawing Sheets

(56) References Cited

OTHER PUBLICATIONS

Green Lodging News. "New Patented Valve from H20 Guard Stops Running Toilets." Internet. Available at http://greenlodgingnews.com/New-Patented-Valve-Valve-H2O-Guard-Stops-Running-Toilets. Visited Apr. 14, 2015.
Leakalertor. "Ask the Engineers." Internet. Available at http://leakalertor.com/general-faqs/technical-faqs/. Visited Mar. 24, 2015.
Leak Bird Industries. "About—LeakBird." Internet. Available at http://web.archive.org/web/20140829070046/http://www.leakbird.com/about.html. Archived Aug. 29, 2014.
Parrish, David M. "Toilet Guardian-TG 1000." Internet. Available at http://aquaone.com/category/toilet-guardian-products/. Visited Apr. 14, 2015.
Water R8. "How WaterR8 Works." Internet. Available at http://www.water-r8.com/How-WaterR8-Works.aspx. Visited Mar. 24, 2015.

* cited by examiner

IN-TOILET LEAK DETECTOR

BACKGROUND OF THE INVENTION

1. Field of the Invention

Generally speaking, the invention relates to water flow detection, and more specifically, to an in-toilet leak detector.

2. Description of Related Art

Wasting water has enormous practical, financial, and environmental consequences. Undetected leaks in plumbing fixtures, like toilets, are one of the most insidious sources of wasted water. Especially in a commercial establishment, like a hotel, a few leaking toilets can seriously increase water costs. Beyond mere wastage, a leak can be a harbinger of a larger problem that will require a larger repair effort and possibly cause more damage if it is not caught.

U.S. Pat. No. 6,802,084 to Ghertner et al. discloses a toilet tank leak detection and reporting system. The system uses a flow sensor placed in the toilet tank. The system senses water flow based on the resistance of the flowing water, and includes a timing module. If the water flows for a shorter or longer time than usual, the system activates an alarm. While an embodiment of this patent's leak detection system has been sold successfully for a number of years, there are certain drawbacks. For example, while the sensor is within the toilet, the electronics for the system are placed outside of the toilet bowl, leaving the leads for the contacts exposed.

SUMMARY OF THE INVENTION

One aspect of the invention relates to an in-toilet leak detector. The leak detector is constructed and arranged to remain entirely within a toilet tank. In the leak detector, an inlet is connected to the fill tube of the toilet tank and diverts water downwardly, through a flow tube that empties out into the overflow tube of the toilet tank, thus filling the toilet bowl. Within the leak detector between the inlet and the outlet opening of the flow tube is a sensor. In some embodiments, the sensor may be a capacitive sensor with one electrode along the interior of the flow pathway between the inlet and the flow tube and the other electrode positioned around the exterior of the flow tube. A housing is connected to the inlet and flow tube, and contains a controller for the leak detector, as well as one or more transceivers and other input-output components. When water flows into the tank after a flush, the leak detector detects the water flow and the controller times it. If the duration of water flow is over or under a calibrated time, an alert is established.

Another aspect of the invention relates to systems for reporting toilet leak alerts. The system comprises one or more leak detectors of the type described above, each of which has transceivers adapted to connect it wirelessly in or to a computer network. When leak alerts are established by the one or more leak detectors, they may be transmitted over a computer network, such as the Internet, to a server or servers that handle them. The alerts may be communicated via an e-mail or SMS gateway directly to individuals responsible for handling the maintenance of the leaking toilet.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the views, and in which.

DETAILED DESCRIPTION

Figure 1:
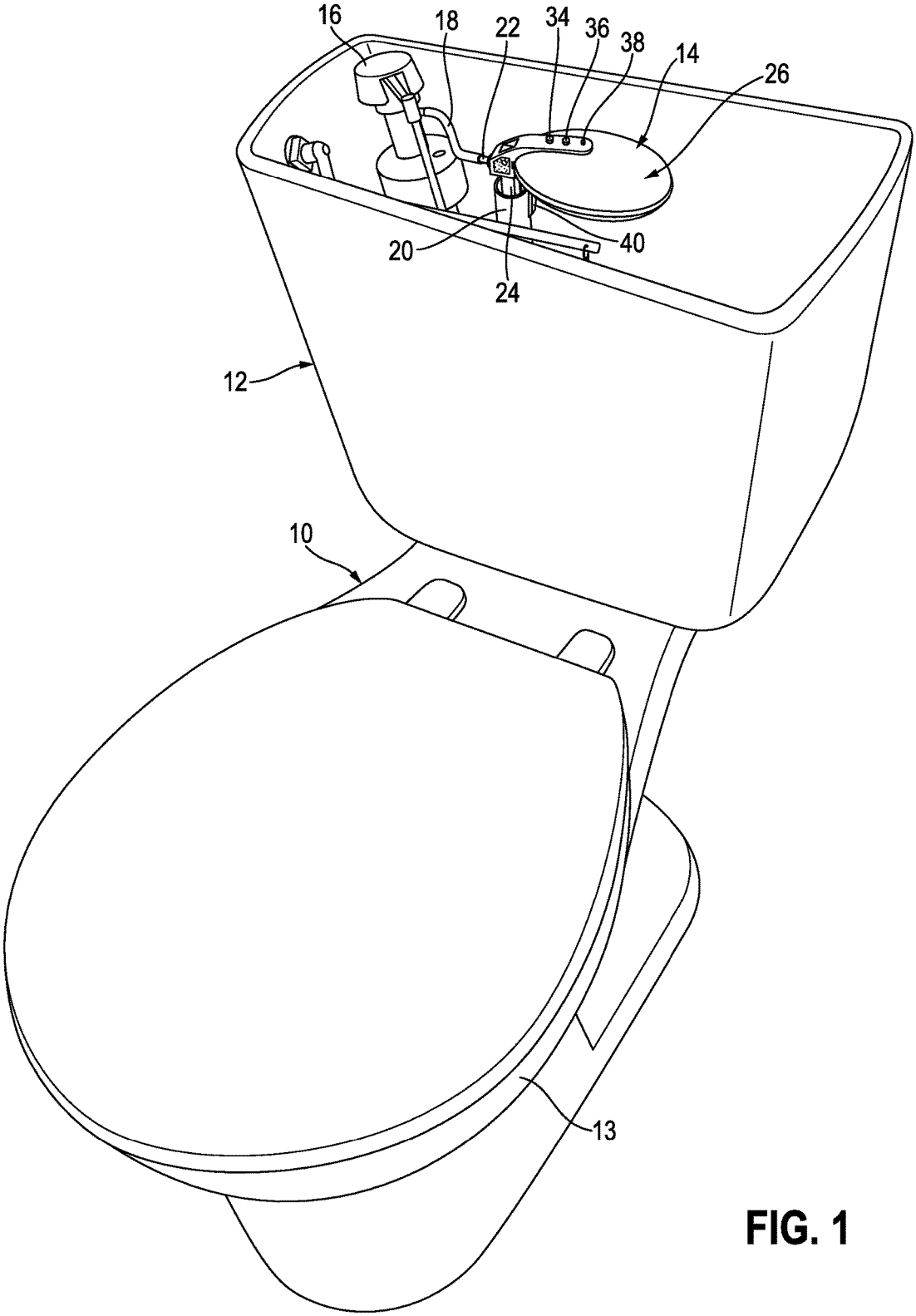
FIG. 1 is a perspective view of a toilet with the tank lid removed, illustrating the installation of an in-toilet leak detector according to one embodiment of the invention.
Figure 2:
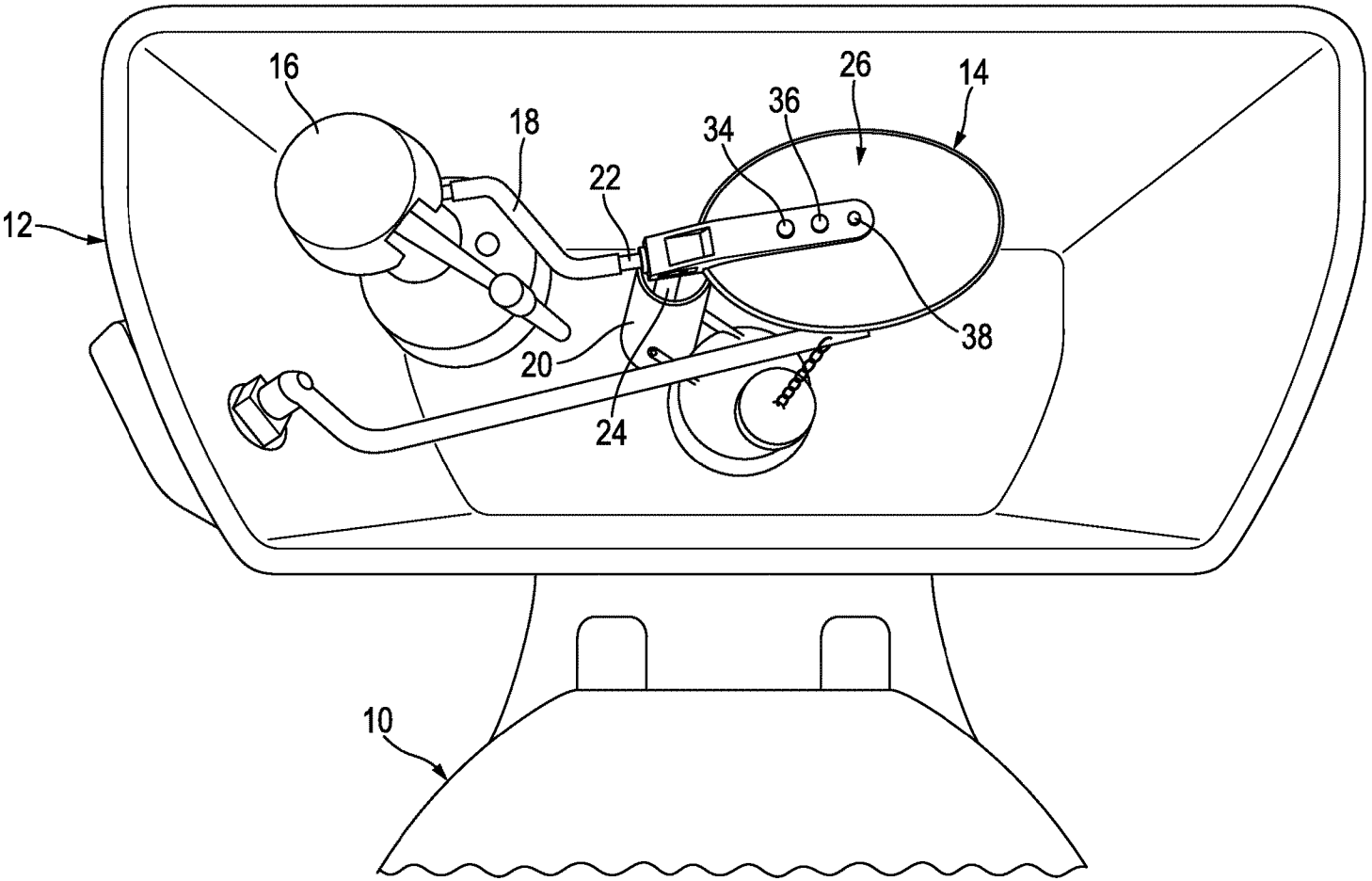
FIG. 2 is a top plan view of the toilet, illustrating the installation of the in-toilet leak detector in more detail.

FIG. 1 is a perspective view of a toilet 10 with the lid of the toilet tank 12 removed to show the placement of an in-toilet leak detector, generally indicated at 14, according to one embodiment of the invention. FIG. 2 is a top plan view illustrating the placement of the leak detector 14 in more detail.

As shown in FIGS. 1 and 2, the fill valve assembly 16 of the toilet is unmodified, and terminates in a fill tube 18, through which water flows to fill the toilet bowl 13. Instead of ending in a spigot that allows water to flow into the overflow tube 20 of the tank 12, as it would in a typical toilet, the fill tube 18 attaches to the intake 22 of the leak detector 14. Water flowing from the fill tube 18 is diverted through a flow tube 24 of the leak detector 14, which is positioned over the overflow tube 20 of the tank 12, and exits downwardly into the overflow tube 20 of the tank 12. When water flows within the flow tube 24 of the leak detector 14, it is detected by the leak detector 14. The duration of the water flow during each flush of the toilet is used to determine whether or not there is a leak within the toilet.

Figure 3:
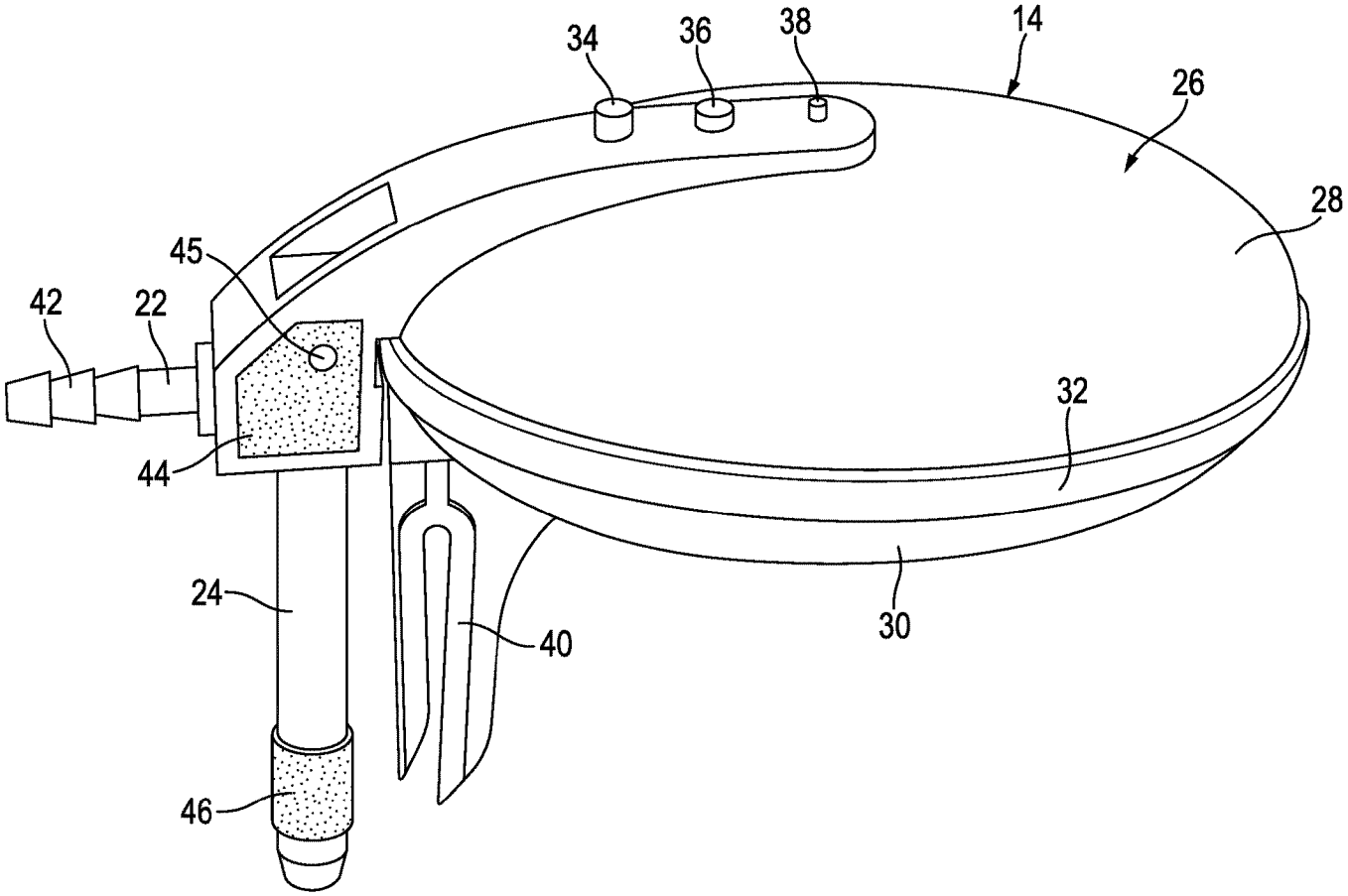
FIG. 3 is a side elevational view of the in-toilet leak detector in isolation.

FIG. 3 is a side elevational view of the leak detector 14 in isolation. As shown in FIGS. 1-3, the leak detector 14 has a housing 26, which contains the electronics and control elements for the leak detector 14. In the illustrated embodiment, the housing 26 is elliptical in overall shape and has a relatively low profile. Of course, the shape of the housing 26 is not critical as long as the housing 26 has a relatively low profile and does not interfere with the lid of the toilet tank 12 or other components. Preferably, the housing 26 is made of a plastic or another water-resistant material polymeric material, like high-density polyethylene (HDPE), acrylonitrile-butadiene-styrene (ABS) plastic, and other such materials. Typically, the housing 26 has upper and lower halves 28, 30 that are sealed with a rubber boot or gasket 32. The rubber of the rubber boot or gasket 32 may be, for example, a thermoplastic elastomer. The degree to which the housing 26 is water-tight will vary from embodiment to embodiment; it is sufficient in most circumstances if the housing 26 resists moisture and splashes and can remain within the toilet tank 12 for a long period of time. The housing 26 has two buttons 34, 36 and an indicator light 38 whose purpose will be explained in greater detail below. While buttons 34, 36 are used in the illustrated embodiment, other types of controls may be used in other embodiments, including membrane switches.

In the illustrated embodiment, a depending clip 40 with a generally vertically-oriented slot is attached to the underside of the housing 26. The clip 40 is sized and arranged to allow the leak detector 14 to clip on to the overflow tube 20 so that the flow tube 24 of the leak detector 14 empties into the overflow tube 20, as shown in FIGS. 1 and 2.

Figure 4:
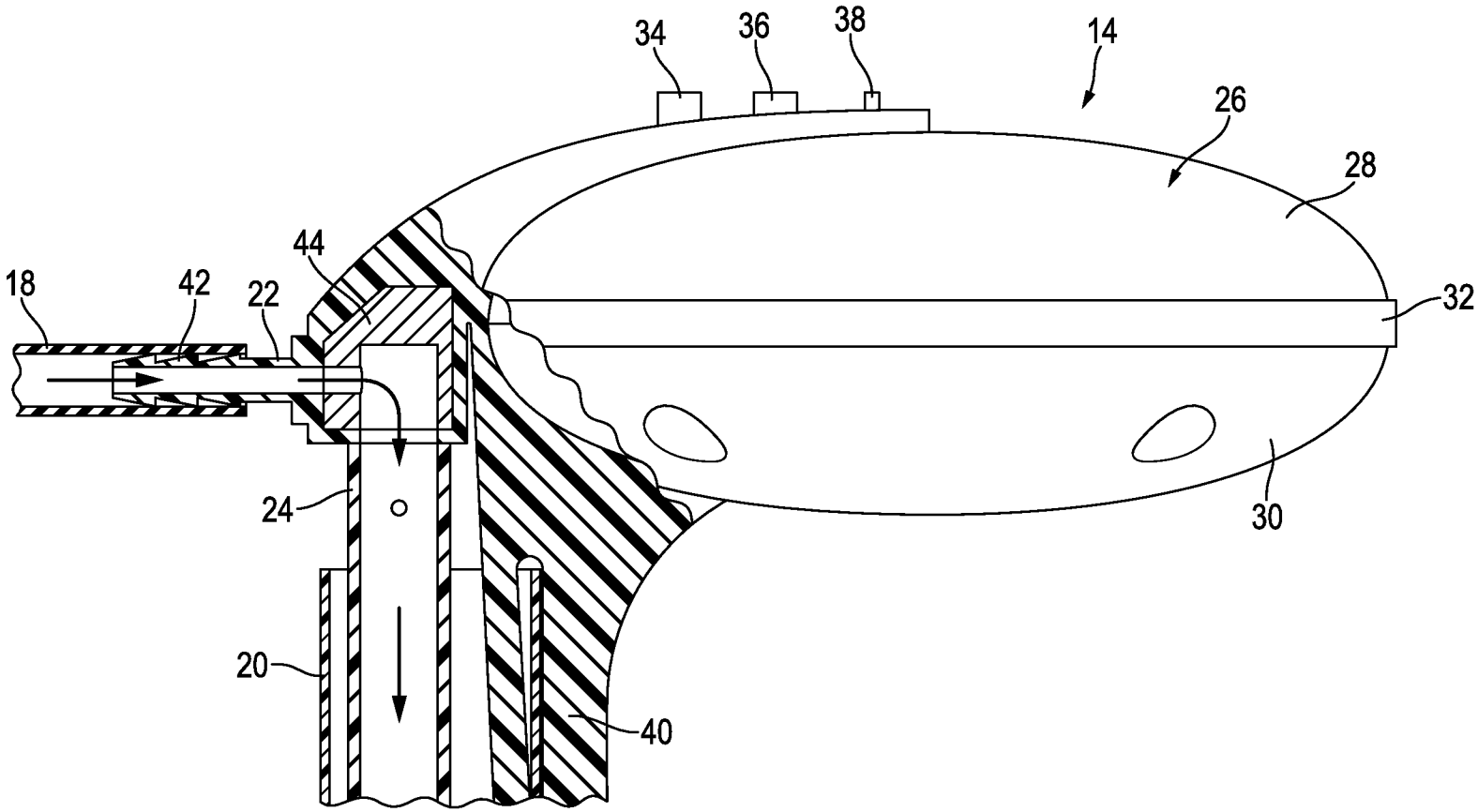
FIG. 4 is a partially sectional side elevational view of the in-toilet leak detector.

FIG. 4 is a partially sectional elevational view of the leak detector 14, illustrating water flow in and through the leak detector 14. As shown, the intake 22 has a barbed nipple 42 that receives and retains the fill tube 18 of the toilet 10. Water from the fill tube 18 enters the intake 22 and passes through a metal block 44, which diverts it downward, through and ultimately out of the flow tube 24 to fill the toilet bowl 13.

As shown in FIG. 3, a conductive metal ring or band 46 is wrapped around the exterior of the flow tube 24 toward its bottom. The metal block 44 and the metal ring 46 are arranged so that they are not in direct electrical contact with one another—the metal block 44 is on the inside of the flow tube 24 and the metal ring 46 is on the outside. Thus, the metal ring 46, which may be copper or brass, never directly contacts the water flowing through the flow tube 24. However, as they are positioned, the two parts 44, 46 are separated by a dielectric—air and plastic when no water is flowing, and a combination of air, water, and plastic when water is flowing. Therefore, the two parts 44, 46 have a variable capacitance, depending on whether or not water is flowing. In order to determine whether water is flowing, the leak detector 14 measures the capacitance between the metal block 44 and the metal ring 46. Of course, the metal block 44 and metal ring 46 are not the only components that may be used to sense capacitance. For example, a brass tube may be used along the interior of the flow tube 24 instead of the metal block 44. Additionally, a brass tube may extend from the bottom of the metal block 44 to a point just above the metal band 46, and the water may drain through that tube, instead of into the flow tube 24 itself. Additionally, as can be seen in FIG. 4, the flow tube 24 or metal block 44 includes a drain hole 45 that primarily serves to prevent a vacuum from forming within the flow tube 24.

The metal ring 46 is typically electrically insulated along its exterior, so that water droplets and splashes will not cause an electrical short or a false reading. This can be done quickly and inexpensively by shrink-wrapping the metal ring 46 with an appropriate plastic. However, in other embodiments, the metal ring 46 could be overmolded, so that it is covered with a thicker layer of molded plastic or rubber and is not visible from the exterior of the leak detector 14. Any exposed surfaces of the metal block 44 that might cause errant readings may also be coated or passivated in any known manner.

While the illustrated embodiment emphasizes measurement of capacitance as an indicator of flow, as those of skill in the art will understand, embodiments of the invention may measure any characteristic of an electric circuit that includes the metal block 44 and the metal ring 46 and depends directly or indirectly on whether water is flowing between the two electrodes 44, 46. This may include measurements of the time-dependent characteristics of resistor-capacitor (RC), inductor-capacitor (LC) or resistor-inductor-capacitor (RLC) circuits that include the metal block 44 and the metal ring 46.

Figure 5:
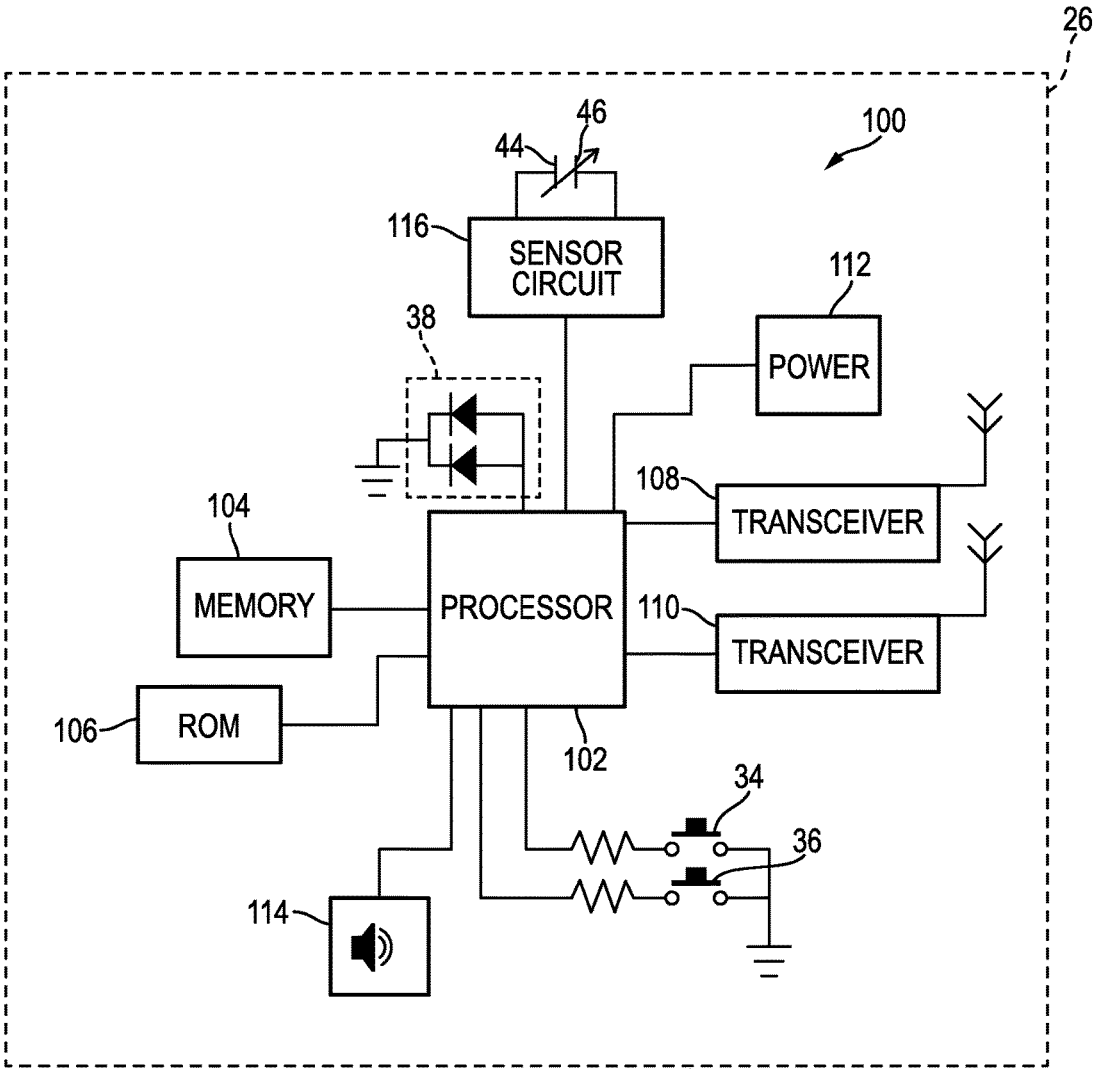
FIG. 5 is a schematic illustration of the components of the controller for the in-toilet leak detector.

As was described briefly above, the housing 26 contains the control electronics for the leak detector 14. Typically, one or more printed circuit boards with the control electronics would be mounted within the housing. FIG. 5 is a schematic diagram of the control electronics, generally indicated at 100.

The control electronics 100 include a central unit, such as a processor 102. In other embodiments, the central unit may be an application-specific integrated circuit or any other type of integrated circuit capable of performing the functions described here. As one example, the processor 102 may be a PIC18F46J50 microprocessor from Microchip Technology, Inc. of Chandler, Ariz., U.S.A.

Coupled to the processor 102 are a number of components: a memory 104, a read-only memory (ROM) 106, one or more transceivers 108, 110, and, optionally, a speaker 114. As shown, the processor 102 is connected to the metal block 44 and metal band 46 through a sensor circuit 116; to the indicator light 38, which may comprise one or more light-emitting diodes (LEDs) 118, 120, each of a different color; and to the two buttons 34, 36 through appropriate circuitry. A power source 112 is also provided. The power source 112 would typically be a battery.

The memory 104 would typically be a FLASH memory, or any other type of memory that can be used to temporarily store instructions and data. The ROM 106, which may be an electrically eraseable programmable ROM (an EEPROM), typically contains software for the processor 102 that enables it to execute the tasks necessary to detect leaks using the components of the leak detector 14.

The control electronics 100 may include any number of transceivers 108, 110, each of which would typically be a complete radio system for communicating via a particular radio communication protocol. These transceivers 108, 110 would allow the leak detector 14 to communicate with other information systems, as will be described below in more detail. Communication protocols that may be used by the leak detector 14 include traditional WiFi (IEEE 802.11a/b/g/n), Bluetooth, and other protocols like ZigBee or MiWi point-to-point communication protocols (IEEE 802.15.4). ZigBee and MiWi may be particularly suitable in some embodiments, as they are low-power protocols. With point-to-point communication protocols, longer-range communications are handled through "mesh networks" of similar devices. In some cases, a leak detector 14 may also have a conventional input-output data port, such as a universal serial bus (USB) port, so that it can be connected directly to a computer by a hardwired connection for diagnostic or other purposes. Of course, if such a port in the housing 26 is provided, it would typically be well covered by a waterproof cover. In addition to the transceivers 108, 110, the indicator light 38 with its LEDs 118, 120, the speaker 114 (if one is present) and the buttons 34, 36 are used for input and output.

Figure 6:
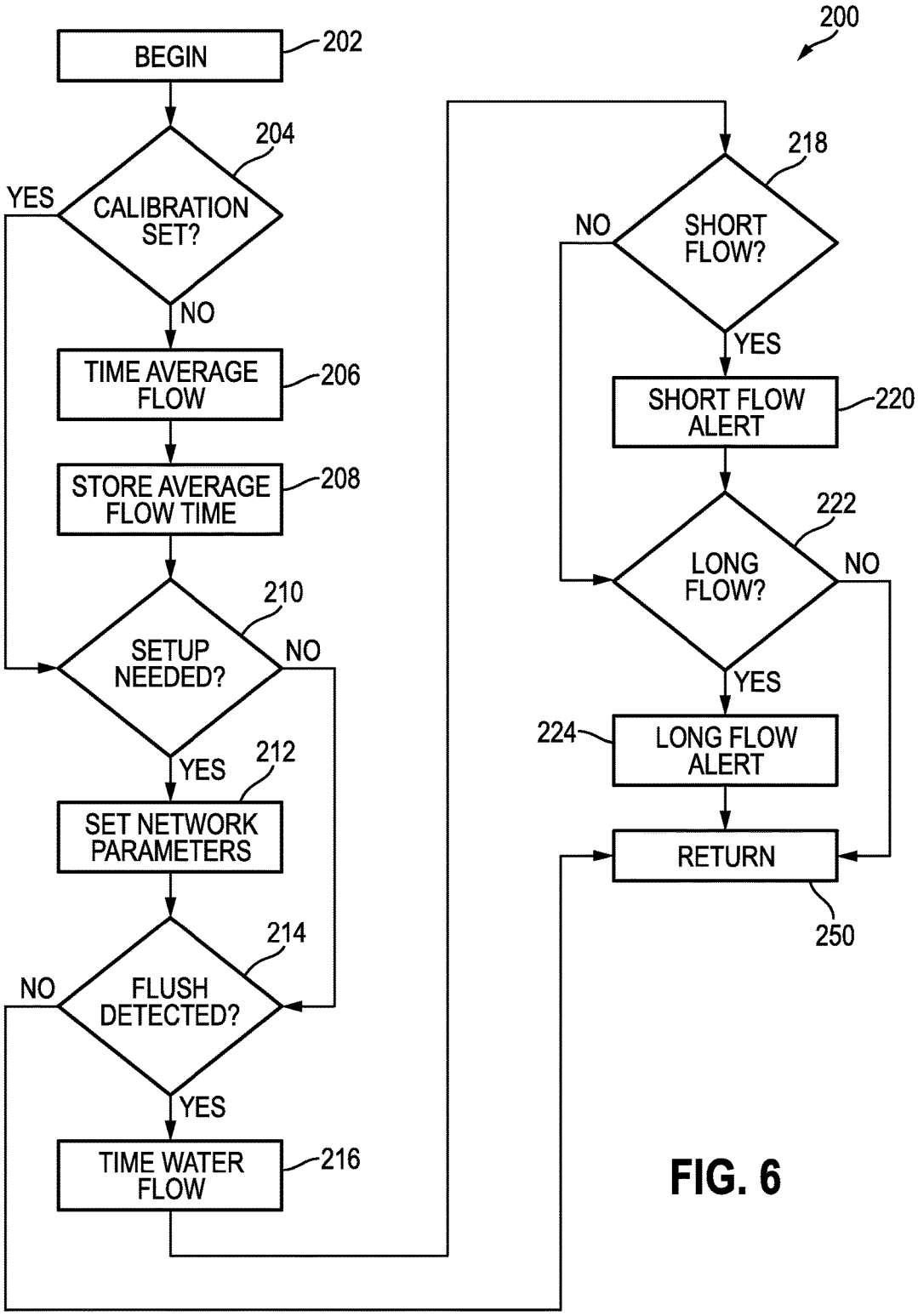
FIG. 6 is a high-level flow diagram of a method for detecting leaks using the in-toilet leak detector.

The functions of the processor 102 are detailed with respect to FIG. 6, a high-level flow diagram of a method, generally indicated at 200, for detecting leaks using the leak detector 14. Method 200 begins at task 202 and continues with task 204. In task 204, a decision task, the processor 102 determines whether the leak detector 14 has been calibrated.

As was described briefly above, the leak detector 14 uses a capacitance measurement to determine when water is flowing into the toilet 12. If a water flow is detected, that water flow is timed. If the flow is too short or too long, that indicates that a leak is present. In order to have a baseline for comparison, if a calibration has not been set (task 204: NO), the user can place the leak detector 14 in a calibration mode and then flush the toilet 12. Method 200 then continues with task 206, the leak detector 14 times the duration of the flush, and that duration is stored in task 208. In some embodiments, calibration mode may require several flushes, and the duration that is stored may be the median, mean, or some other statistic describing what the baseline duration of flow should be. Of course, collecting this data may not be necessary in all embodiments; instead, the leak detector 14 may be pre-programmed with a baseline flush duration, or the user may be able to select a baseline flow duration depending on the model of the toilet. If calibration data exists (task 204: YES), control of method 200 passes to task 210.

While task 204 is shown at the beginning of method 200 for clarity in illustration and explanation, in actuality, the leak detector 14 may be calibrated or recalibrated at any time by placing the detector 14 into calibration mode. This would typically be done by pressing one of the buttons 34, 36, or a sequence of the buttons 34, 36. The processor 102 may light one of the LEDs 118, 120 to acknowledge that the leak detector 14 is in calibration mode. Method 200 continues with task 210.

Task 210, another decision task, asks whether setup is necessary. In addition to calibration for leak detection, the leak detector 14 is most advantageously configured to communicate through a computer network to one or more computers. If the setup necessary to allow that communication has not been done (task 210: NO), method 200 continues with task 212, and that setup is performed.

In task 212, setup options that may need to be configured include the internet protocol (IP) address of the leak detector 14, the IP address of its gateway or repeater, point-to-point protocol options, and other conventional network parameters, depending on the protocols by which the leak detector 14 is to communicate. This may be done either using the buttons 34, 36 on the housing 26 itself, or through a communication interface provided by the network (as will be described below). Like the calibration of task 204, the setup of task 210 may be performed, or reset, at any time using the buttons 34, 36 on the housing. For example, the user may simultaneously depress both buttons 34, 36 to cause the leak detector 14 to reset its network settings. In one case, if the leak detector 14 is using Bluetooth, depressing both buttons may cause the leak detector 14 to become discoverable for Bluetooth pairing, and task 212 may involve Bluetooth pairing. Method 200 continues with task 214.

Once the leak detector is interfaced and calibrated, it may enter a low-power "sleep" mode to minimize power consumption until a toilet flush is detected. In addition to flushes, depressing a specified button 36, 38 may bring the leak detector 14 out of sleep mode and cause it to display its status via the indicator light 38. When a toilet flush is detected (task 214: YES), method 200 continues with task 216 and the processor 102 times the duration of water flow. If no flush is detected (task 214: NO), method 200 continues with task 250 and returns.

After task 216, method 200 continues with task 218, another decision task. In task 218, if the flow is shorter than the calibrated baseline, method 200 continues with task 220 and a short flow alarm is established. If there is no short flow (task 218: NO), method 200 continues with task 222, in which the processor 102 determines whether or not the flow was too long. If the flow was too long (task 222: YES), a long flow alert is established in task 224. If the flow was not too long, and thus, the flush was normal (task 222: NO), method 200 returns at task 250.

Thus, the leak detector 14 is capable of distinguishing two different leak conditions: flow that is too short, and flow that is too long. The conditions described above are simplified. In some embodiments, the leak detector 14 may follow the same basic method as described above. However, instead of establishing an alarm based on the duration of a single flush, the leak detector 14 may establish an alarm only if X number of flushes of the last Y total flushes were over or under the baseline water flow time. For example, an alarm may only be established if three out of the last 12 flushes consistently showed a long duration flow or a short duration flow. In that case, the method would include the additional step of storing the flow time after task 216, and the decision tasks 218 and 222 would be based on the last Y total flushes.

By being capable of detecting two different types of errant flow conditions, the leak detector 14 can also assist the user in diagnosing the root cause of the leak. For example, a short duration flow can indicate a leaking flapper valve. A long duration flow can indicate, for example, a bad flush valve, a bad fill valve, or a float arm that is stuck in place, to name a few possible causes. In some cases, the leak detector 14 may also be configured and programmed to report a certain level of inconsistency in flushes (e.g., a certain number of short flushes and a certain number of long flushes in the same period or window). Additionally, although method 200 asks whether the flush duration is greater or less than a baseline calibrated duration, other embodiments may use other metrics. For example, method 200 may instead ask whether the duration of flow is more than one or two standard deviations greater or less than a calibrated flow time or a calibrated mean flow time. If this is done, separate alarms may be established depending on the severity of the leak. Other statistics and metrics will be apparent to those of skill in the art.

Tasks 220 and 224 of method 200 involve establishing an alert that there is either a long flow or a short flow leak. In embodiments of the invention, establishing an alert can involve different types of actions, depending on how the leak detector 14 is configured. In many or most embodiments, establishing an alert can refer to creating a visual alarm using the LEDs 118, 120, typically with a different light pattern to distinguish between different types of alerts. Establishing an alert can also refer to using a speaker 114, if one is installed, to create an auditory alert. However, it may be more effective simply to report the leak condition to a responsible individual, and embodiments of the invention can be configured to do just that.

Figure 7:
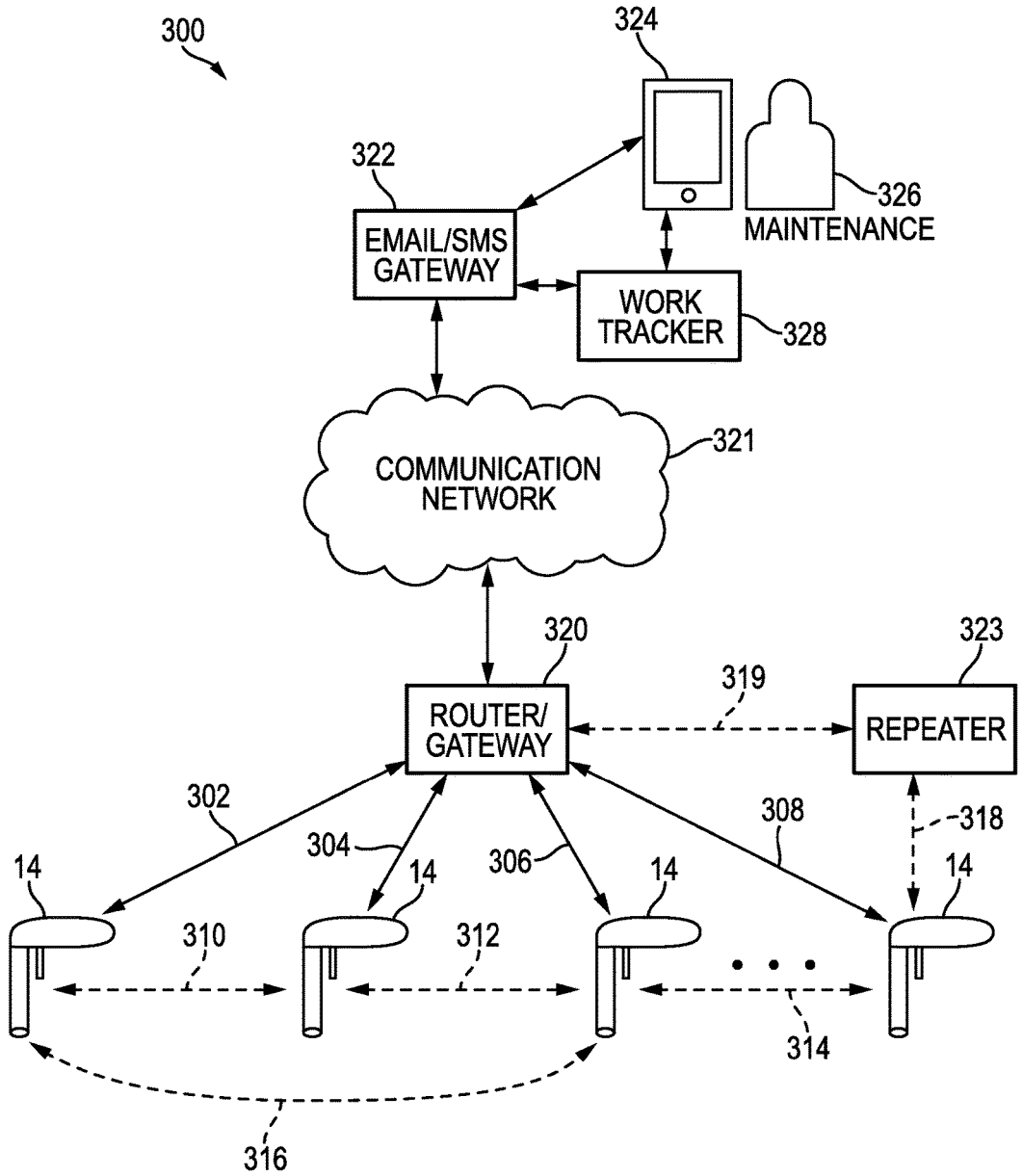
FIG. 7 is a diagram of a system allowing communications and alerts from one or more in-toilet leak detectors to be communicated and processed electronically.

FIG. 7 is an illustration of a broader system, generally indicated at 300, in which one or several leak detectors 14 may be networked together to report alerts and, more generally, to be accessed and controlled remotely. Depending on the types of transceivers 108, 110 installed in the leak detectors 14, the system 300 may use a variety of protocols (e.g., Wifi, ZigBee, MiWi, Bluetooth) for communication. FIG. 7 actually illustrates communication schemes for two different kinds of communication protocols.

In a first communication scheme, as shown by the solid arrows 302, 304, 306, 308, each of the leak detectors 14 may have its own IP address and may communicate directly with a router or gateway 320. This would typically be the case if the communication protocol is WiFi.

A second communication scheme is shown by the dotted-line arrows 310, 312, 314, 316, 318, 319. In this scheme, a point-to-point communication protocol like MiWi or ZigBee is used. One or more of the leak detectors 14 may serve as a repeater, or the leak detectors 14 may be connected together in a mesh network to relay signals from one leak detector 14 to the next. However, the individual leak detectors 14 in this scheme typically would not have IP addresses of their own. Instead, one or more of the leak detectors 14 communicates with a repeater 323 that does have an IP address, or another type of address, identifier, or credential needed to communicate with an outside network. As shown in FIG. 7, the repeater 323 communicates with the router or gateway 320.

In either communication scheme, the router or gateway 320 communicates with a communication network 321, such as the Internet, although in some embodiments, the communication network 321 may be a private network that uses transmission control protocol/internet protocol (TCP/IP) and other common Internet protocols but does not interface with the broader Internet, or does so only selectively through a firewall.

The system that receives and processes signals from the leak detectors 14 may differ from embodiment to embodiment. In the illustrated embodiment, alerts and signals from the leak detectors 14 are sent through an e-mail or simple message service (SMS; text message) gateway so that they can be sent as e-mails or SMS text messages to a device 324 monitored by a responsible individual 326, group of individuals, or department, such as a maintenance department. Thus, if a particular leak detector 14 creates an alert because of a leak, that alert can be sent, in e-mail or SMS form, directly to the individual responsible for fixing it. Of course, e-mail and SMS are only two examples of communication methods that may be used; in other embodiments, different forms of communication may be used.

In some embodiments, alerts and other data from the leak detectors 14 may also be sent to a work tracking system 328 that allows the individual 326, or the organization for which he or she works, to track the status of the various alerts that are received, to schedule particular workers to repair particular toilets, and to track the status of those repair jobs. A work tracking system 328 would typically be a server, such as a Web server, that provides an interface individuals and organizations can use, typically through the communication network 322. In addition to its work tracking functions, the work tracker 328 may allow broader data logging and analysis functions. For example, water consumption data may be calculated from the flow duration data collected by the leak detectors 14, and the system 328 may be able to provide aggregate water consumption data for a toilet 10 or group of toilets 10.

The system 300 also allows individuals 326 to access the individual leak detectors 14 for configuration and diagnostic purposes. In that case, the individual processors 102 of the leak detectors 14 may be configured to act as Web servers that use a protocol like hypertext transfer protocol (HTTP) to provide an online interface that can be used to configure the leak detectors 14. In some embodiments, the systems 322, 328 may be used to configure several leak detectors 14 at once. For example, if several toilets 10 are of the same model and are in similar locations in the same building, it may not be necessary to configure the leak detectors 14 individually. Instead, an individual 326 may provide configuration information, including a baseline flow duration, for several leak detectors 14 at once.

While the above description focuses on detection of leaks, the leak detectors 14 may be used for broader water conservation purposes irrespective of whether or not a leak exists. For example, instead of detecting leaks, the flow timing capabilities of a leak detector 14 may be used to determine, quantitatively or qualitatively, how much water a particular toilet 10 is using. In that case, if the goal is reducing water consumption, the leak detector 14 could establish an alert if a toilet's consumption is over a threshold level.

While the invention has been described with respect to certain embodiments, the description is intended to be exemplary, rather than limiting. Modifications and changes may be made within the scope of the invention, which is determined by the appended claims.

What is claimed is:

1. A leak detector for a toilet having a toilet tank, comprising:

an inlet adapted to connect to a toilet fill tube;

a nonconductive flow tube, the flow tube being connected to the inlet to receive water from the inlet, having an opening at one end that allows the water from the inlet to flow through the flow tube and out of the opening, and being operationally arranged relative to the inlet within the toilet such that water flowing out of the opening is directed into an overflow tube of the toilet so as to fill a toilet bowl;

a first metal contact along an interior surface of the flow tube between the inlet and the opening of the flow tube, such that water entering the flow tube will flow over or through the first metal contact and a second metal contact along an exterior surface of the flow tube between the inlet and the opening of the flow tube, the first and second metal contacts being electrically isolated from one another by the flow tube, such that the first and second metal contacts serve as a capacitor for which capacitance is measured in a capacitive sensor;

a water-tight housing connected to the flow tube and the inlet, the housing being sized and configured to remain within the toilet tank;

a depending clip connected to the underside of the housing and positioned to retain and support the leak detector on the overflow tube of the toilet, the clip being arranged relative to the flow tube such that when the leak detector is positioned on the overflow tube of the toilet, the flow tube extends into the overflow tube;

a controller coupled to the sensor and disposed within the housing, the controller being adapted to determine long flow and short flow conditions based on measuring flow duration using the capacitive sensor; and one or more wireless transceivers connected to the controller.

2. The toilet leak detector of claim 1, wherein the first metal contact comprises a metal block between the inlet and the flow tube with a passageway therein that diverts the water from the inlet downwardly into the flow tube.

3. The toilet leak detector of claim 2, wherein the second metal contact comprises a metal ring positioned along the exterior of the flow tube.

4. A system for detecting and communicating toilet leaks, comprising:

one or more toilet leak detectors, each of the one or more toilet leak detectors comprising a device that sits entirely within a toilet tank of a toilet, each of the one or more toilet leak detectors including an inlet adapted to connect to a toilet fill tube, a nonconductive flow tube, the flow tube being connected to the inlet to receive water from the inlet, having an opening at one end that allows the water from the inlet to flow through the flow tube and out of the opening, and being operationally arranged relative to the inlet within the toilet such that water flowing out of the opening is directed into an overflow tube of the toilet so as to fill a toilet bowl, a first metal contact along an interior surface of the flow tube between the inlet and the opening of the flow tube, such that water entering the flow tube will flow over or through the first metal contact and a second metal contact along an exterior surface of the flow tube between the inlet and the opening of the flow tube, the first and second metal contacts being electrically isolated from one another by the flow tube, such that the first and second metal contacts serve as a capacitor for which capacitance is measured in a capacitive sensor, a water-tight housing connected to the flow tube and the inlet, the housing being sized and configured to remain within the toilet tank, a depending clip connected to the underside of the housing and positioned to retain and support the leak detector on the overflow tube of the toilet, the clip being arranged relative to the flow tube such that when the leak detector is positioned on the overflow tube of the toilet, the flow tube extends into the overflow tube, a controller coupled to the sensor and disposed within the housing, the controller being adapted to determine long flow and short flow conditions based on measuring flow duration using the capacitive sensor, and one or more transceivers configured and adapted to connect the toilet leak detector to a computer network;

one or more servers connected to the computer network and adapted to receive the alerts from the one or more toilet leak detectors over the network; and a gateway that transmits the alerts using a second network or protocol.

5. The system of claim 4, wherein the second network comprises e-mail or simple message service (SMS).

6. The system of claim 4, further comprising one or more repeaters adapted to communicate signals from the one or more toilet leak detectors to the gateway.

7. The system of claim 4, wherein each of the one or more toilet leak detectors implements a point-to-point communications protocol using at least one of the one or more transceivers.

8. The system of claim 4, wherein the controller is further adapted to establish an alert if the long flow or the short flow condition exists based on data from a single flush.

9. The system of claim 4, wherein the controller is further adapted to establish an alert if the long flow or the short flow condition exists based on X number of flushes of a previous total Y flushes, X and Y being greater than 1, and Y being greater than X.

10. The leak detector of claim 1, wherein the inlet comprises a barbed nipple.

11. The leak detector of claim 1, wherein the second metal contact comprises a metal ring positioned around the exterior surface of the flow tube.

12. The leak detector of claim 11, wherein the second metal contact is wrapped or overmolded.

13. The leak detector of claim 1, wherein the housing comprises first and second portions sealed by a rubber boot or gasket.

14. The leak detector of claim 1, wherein the housing, flow tube, and clip are made of a plastic.

15. The leak detector of claim 1, wherein the first metal contact comprises a block or tube through which the water flows over or through.

16. The leak detector of claim 1, wherein the first and second metal contacts comprise copper or brass.

17. The leak detector of claim 1, wherein the first and second metal contacts are separately electrically connected to a capacitive detecting circuit within the housing.

18. The leak detector of claim 2, wherein the inlet comprises a barbed nipple.

* * * * *